US008104096B1

(12) United States Patent
Jenney

(10) Patent No.: US 8,104,096 B1
(45) Date of Patent: Jan. 31, 2012

(54) INFLATABLE BATHING SUIT SYSTEM

(76) Inventor: Neil Jenney, New York, NY (US)

( * ) Notice: Subject to any disclaimer, the term of this patent is extended or adjusted under 35 U.S.C. 154(b) by 217 days.

(21) Appl. No.: 12/586,510

(22) Filed: Sep. 23, 2009

(51) Int. Cl.
*A41D 7/00* (2006.01)

(52) U.S. Cl. ..... 2/67; 2/DIG. 3

(58) Field of Classification Search ..... 2/67, DIG. 3; 441/102, 103, 113, 94, 92, 120, 90, 106, 441/108; D21/804
See application file for complete search history.

(56) References Cited

U.S. PATENT DOCUMENTS 262,703 A * 8/1882 Sibley ..... 441/102
1,367,225 A * 2/1921 Barker ..... 441/95
1,580,439 A * 4/1926 Meilland ..... 441/96
1,742,368 A * 1/1930 Nunez ..... 441/102
1,803,898 A * 5/1931 Diamond ..... 441/102
1,854,378 A * 4/1932 Mattson ..... 441/113
2,197,228 A * 4/1940 Then ..... 441/102
2,426,726 A * 9/1947 Combs ..... 441/102
D155,877 S * 11/1949 Crenza ..... D2/735
2,521,205 A * 9/1950 David ..... 441/102
2,524,212 A * 10/1950 Spack ..... 441/120
2,987,737 A * 6/1961 Brenner ..... 441/102
3,049,736 A * 8/1962 Toulmin, Jr. ..... 441/113
3,098,248 A * 7/1963 Geier ..... 441/120
3,130,424 A * 4/1964 Santangelo ..... 441/94
3,134,993 A * 6/1964 McCoy ..... 441/102
3,302,224 A * 2/1967 Boucher ..... 441/94
3,589,366 A * 6/1971 Feather ..... 604/312
3,935,608 A * 2/1976 Freedman et al. ..... 441/92
4,397,636 A * 8/1983 Ganshaw ..... 441/65
5,502,842 A * 4/1996 Wagner ..... 2/67
D424,153 S * 5/2000 Shaffer ..... D21/804
6,231,411 B1 * 5/2001 Vinay ..... 441/120
6,676,467 B1 * 1/2004 Filsouf ..... 441/90
7,150,668 B2 * 12/2006 Kemp ..... 441/106
7,305,715 B2 * 12/2007 Orsos ..... 2/67
7,438,619 B2 * 10/2008 Staver et al. ..... 441/115
2007/0049141 A1 * 3/2007 Staver et al. ..... 441/115

* cited by examiner

*Primary Examiner* — Katherine Moran
*Assistant Examiner* — Richale Quinn

(57) ABSTRACT

A swimming garment is formed with a tunnel having an aperture. An inflation assembly includes an inflatable bladder within the tunnel, a tube having an intermediate extent extending through the aperture and having a lower end coupled to the bladder and having an upper end positionable in the mouth of a wearer for inflation. The majority of the intermediate extent is positionable in the tunnel while not inflating and outside of the tunnel with the upper end in the mouth of the wearer while inflating. A wearer controlled clamp on the tube adjacent to the upper end is opened for inflation and deflation purposes and closed for precluding inflation and deflation.

2 Claims, 2 Drawing Sheets

FIG 1
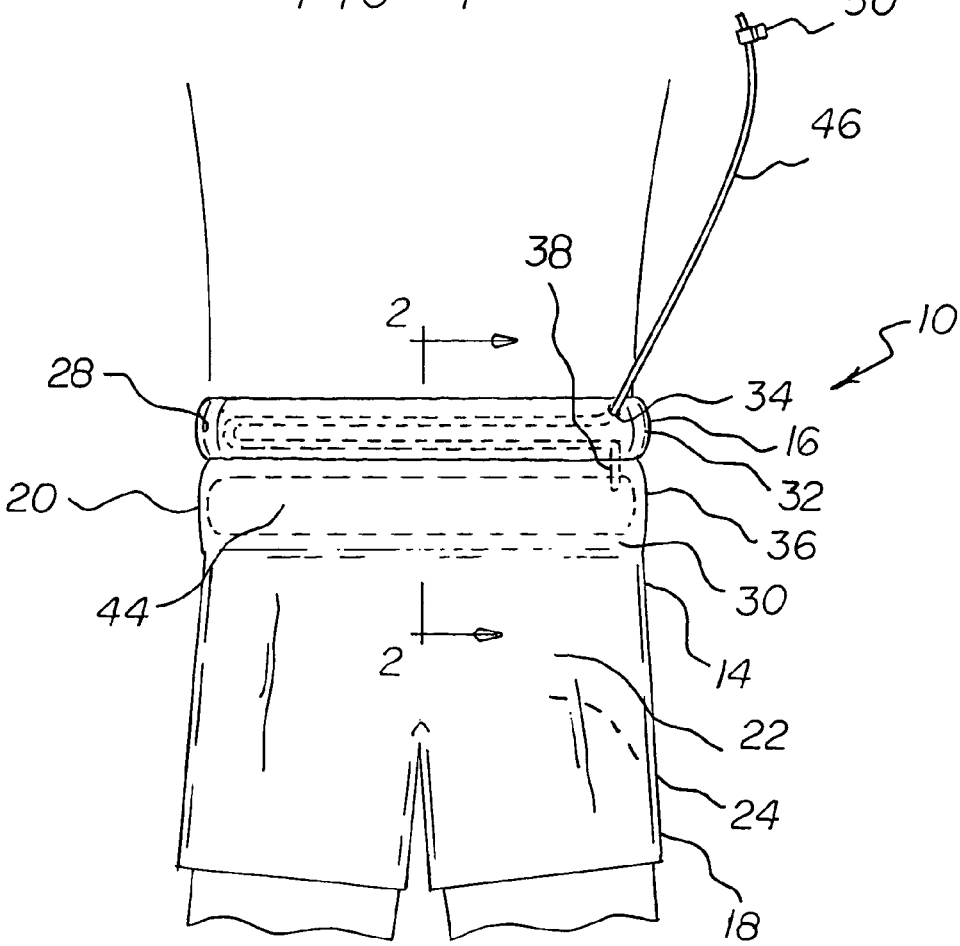
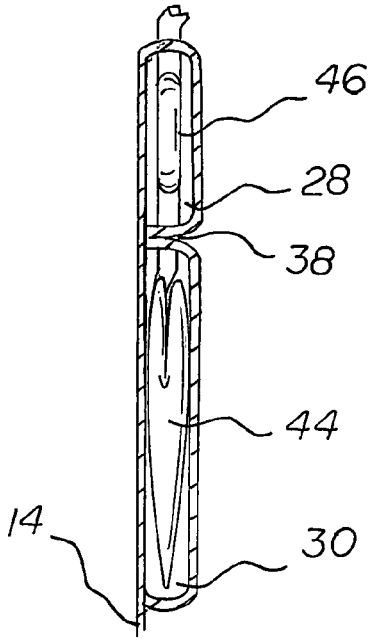
FIG 2

INFLATABLE BATHING SUIT SYSTEM

BACKGROUND OF THE INVENTION

1. Field of the Invention

The present invention relates to a inflatable bathing suit system and more particularly pertains to selectively providing buoyancy to a bathing suit and its wearer at the discretion of the wearer, the providing of buoyancy being done in a safe, convenient, economical and eye-appealing manner.

2. Description of the Prior Art

The use of flotation aids of known designs and configurations is known in the prior art. More specifically, flotation aids of known designs and configurations previously devised and utilized for the purpose of providing buoyancy to swimmers are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,505,766 to J. M. Combs issued Aug. 19, 1924 relating to a bathing suit. U.S. Pat. No. 6,231,411 issued May 15, 2001 to Vinay relates to a Fashionable Emergency Floatation Aid. Lastly, U.S. Pat. No. 7,305,715 issued Dec. 11, 2007 to Orsos relates to a Bathing Suit With Flotation Survival Feature.

While these devices fulfill their respective, particular objectives and requirements, the aforementioned patents do not describe inflatable bathing suit system that allows selectively providing buoyancy to a bathing suit and its wearer at the discretion of the wearer, the providing of buoyancy being done in a safe, convenient, economical and eye-appealing manner.

In this respect, the inflatable bathing suit system according to the present invention substantially departs from the conventional concepts and designs of the prior art, and in doing so provides an apparatus primarily developed for the purpose of selectively providing buoyancy to a bathing suit and its wearer at the discretion of the wearer, the providing of buoyancy being done in a safe, convenient, economical and eye-appealing manner.

Therefore, it can be appreciated that there exists a continuing need for a new and improved inflatable bathing suit system which can be used for selectively providing buoyancy to a bathing suit and its wearer at the discretion of the wearer, the providing of buoyancy being done in a safe, convenient, economical and eye-appealing manner. In this regard, the present invention substantially fulfills this need.

SUMMARY OF THE INVENTION

In view of the foregoing disadvantages inherent in the known types of flotation aids of known designs and configurations now present in the prior art, the present invention provides an improved inflatable bathing suit system. As such, the general purpose of the present invention, which will be described subsequently in greater detail, is to provide a new and improved inflatable bathing suit system and method which has all the advantages of the prior art and none of the disadvantages.

To attain this, the present invention essentially comprises swimming pants fabricated of any appropriate fabric with a bladder fabricated of water repellant polymer. The pants have a top portion above positioned around the waist of the wearer. The pants have a bottom portion below positioned around the legs of the wearer. The pants have an intermediate portion between the top and bottom portions positioned around the thighs of the wearer. The pants also have a front and a back.

The top portion of the pants is formed with a small tunnel at the front of the pants. The intermediate portion if formed with a large tunnel at the front of the pants. The volume of the intermediate portion is between 40 percent and 60 percent greater than the volume of the small tunnel. The small tunnel has a side with an upper aperture. The large tunnel has a side beneath the side of the small tunnel. The pants have a lower aperture between the small and large tunnels.

Next provided is a primary inflation assembly. The primary inflation assembly includes a primary bladder in the large tunnel. The primary bladder has an oval cross sectional configuration when inflated. The primary bladder has a W-shaped segment above and a V-shaped segment below when uninflated. The inflation assembly also includes a primary tube. The primary tube has an intermediate extent extending through the primary aperture. The primary tube also has a lower end coupled to the primary bladder. The primary tube also has an upper end positionable in the mouth of the wearer for inflation. The majority of the intermediate extent is positionable in the small tunnel while not inflating. The majority of the intermediate extent is positionable outside of the small tunnel with the upper end in the mouth of the wearer while inflating.

Next provided is a wearer controlled primary clamp. The clamp is on the primary tube adjacent to the upper end. The clamp is adapted to be opened for inflation and deflation purposes. The clamp is adapted to be closed for precluding inflation and deflation.

Next provided is a swimming bra fabricated of any appropriate fabric with a bladder fabricated of a water repellant polymer. The bra has two laterally spaced strap portions above positioned over shoulders of the wearer. The bra also has a breast portion below. The bra also has a front and a back.

Each strap portion is formed with a large tunnel at the front of the bra. A top aperture is formed in an upper extent of the one of the strap portions.

Next provided is a secondary inflation assembly. The secondary inflation assembly includes a first strap bladder and a second strap bladder in the large tunnels of the strap portions. Each strap bladder has an oval cross sectional configuration when inflated. The secondary inflation assembly also includes a secondary tube. The secondary tube has an intermediate extent passing through the top aperture. The secondary tube has a lower end coupled to the one of the strap bladders and an upper end positionable in the mouth of the wearer for inflation. The majority of the intermediate extent is positionable in the one of the strap portions while not inflating. The majority of the intermediate extent is positionable outside of the tunnel with the upper end in the mouth of the wearer while inflating. The primary tube is several times longer than the secondary tube.

Lastly, a wearer controlled primary clamp is provided. The clamp is on the secondary tube adjacent to its upper end. The primary clamp is adapted to be opened for inflation and deflation purposes. The clamp is adapted to be closed for precluding inflation and deflation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved inflatable bathing suit system which has all of the advantages of the prior art flotation aids of known designs and configurations and none of the disadvantages.

It is another object of the present invention to provide a new and improved inflatable bathing suit system which may be easily and efficiently manufactured and marketed.

It is further object of the present invention to provide a new and improved inflatable bathing suit system which is of durable and reliable constructions.

An even further object of the present invention is to provide a new and improved inflatable bathing suit system which is susceptible of a low cost of manufacture with regard to both materials and labor, and which accordingly is then susceptible of low prices of sale to the consuming public, thereby making such inflatable bathing suit system economically available to the buying public.

Even still another object of the present invention is to provide a inflatable bathing suit system for selectively providing buoyancy to a bathing suit and its wearer at the discretion of the wearer, the providing of buoyancy being done in a safe, convenient, economical and eye-appealing manner.

Lastly, it is an object of the present invention to provide a new and improved swimming garment formed with a tunnel having an aperture. An inflation assembly includes an inflatable bladder within the tunnel, a tube having an intermediate extent extending through the aperture and having a lower end coupled to the bladder and having an upper end positionable in the mouth of a wearer for inflation. The majority of the intermediate extent is positionable in the tunnel while not inflating and outside of the tunnel with the upper end in the mouth of the wearer while inflating. A wearer controlled clamp on the tube adjacent to the upper end is opened for inflation and deflation purposes and closed for precluding inflation and deflation.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a first portion of an inflatable bathing suit system constructed in accordance with the principles of the present invention.

FIG. 2 is a cross sectional view taken along line 2-2 of FIG. 1.

The same reference numerals refer to the same parts throughout the various Figures.

DESCRIPTION OF THE PREFERRED EMBODIMENT

Figure 3:
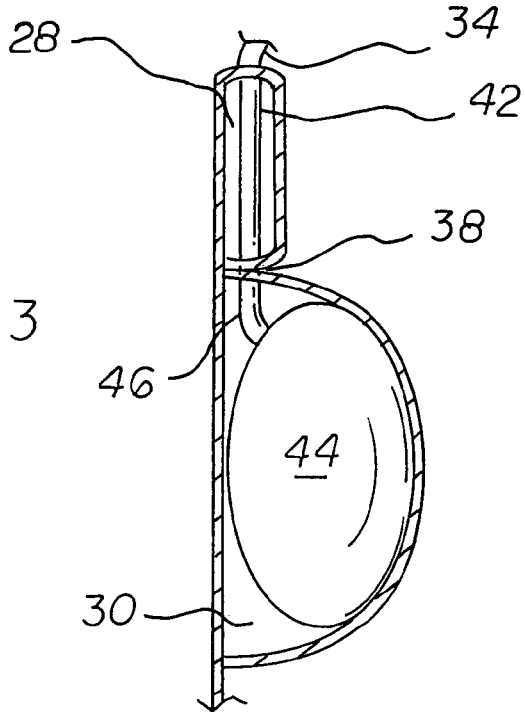
FIG. 3 is a cross sectional view similar to FIG. 2 but with the bladder in an inflated orientation.
Figure 4:
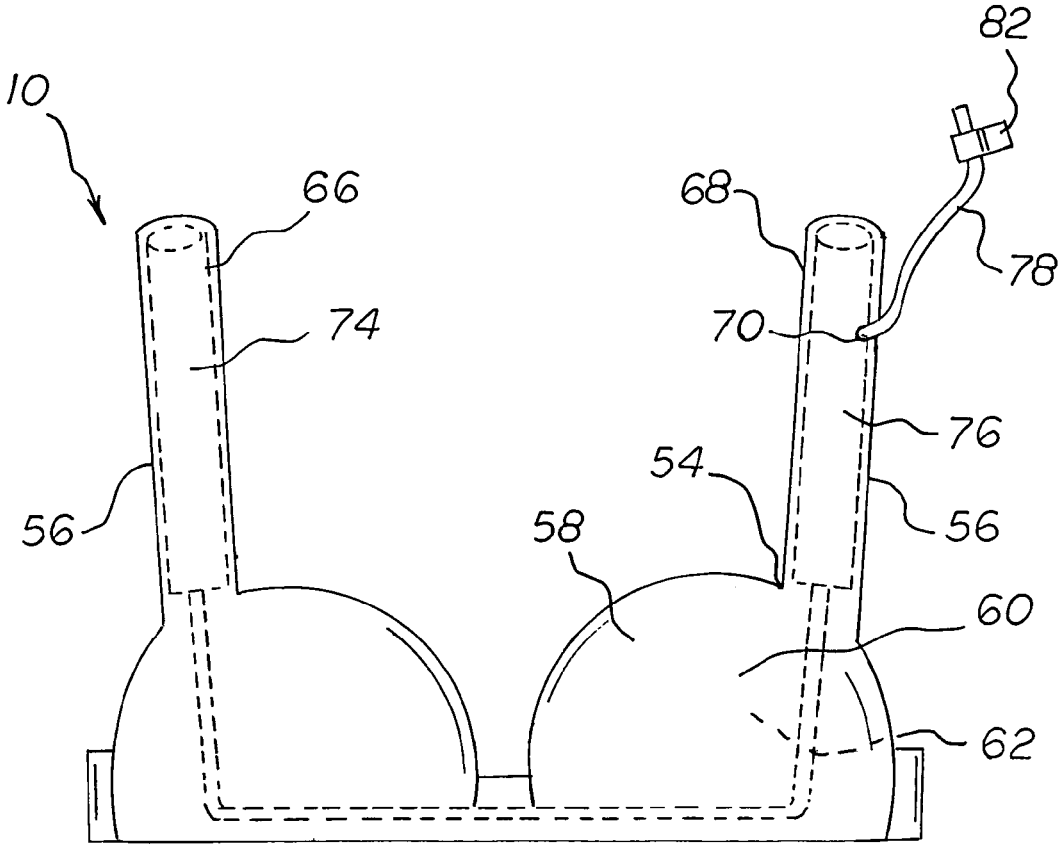
FIG. 4 is a front elevational view of a second portion of an inflatable bathing suit system constructed in accordance with the principles of the present invention.

With reference now to the drawings, and in particular to FIG. 1 thereof, the preferred embodiment of the new and improved inflatable bathing suit system embodying the principles and concepts of the present invention and generally designated by the reference numeral 10 will be described.

The present invention, the inflatable bathing suit system 10 is comprised of a plurality of components. Such components in their broadest context include a swimming garment, an inflation assembly, and a wearer controlled clamp. Such components are individually configured and correlated with respect to each other so as to attain the desired objective.

The inflatable bathing suit system 10 of the present invention is for selectively providing buoyancy to a bathing suit and its wearer at the discretion of the wearer. The providing of buoyancy is done in a safe, convenient, economical and eye-appealing manner. First provided are swimming pants 14 fabricated of any appropriate fabric with a bladder fabricated of a water repellant polymer. The pants have a top portion 16 above positioned around the waist of the wearer. The pants have a bottom portion 18 below positioned around the legs of the wearer. The pants have an intermediate portion 20 between the top and bottom portions positioned around the thighs of the wearer. The pants also have a front 22 and a back 24.

The top portion of the pants is formed with a small tunnel 28 at the front of the pants. The intermediate portion if formed with a large tunnel 30 at the front of the pants. The volume of the intermediate portion is between 40 percent and 60 percent greater than the volume of the small tunnel. The small tunnel has a side 32 with an upper aperture 34. The large tunnel has a side 36 beneath the side of the small tunnel. The pants have a lower aperture 38 between the small and large tunnels.

Next provided is a primary inflation assembly 42. The primary inflation assembly includes a primary bladder 44 in the large tunnel. The primary bladder has an oval cross sectional configuration when inflated. The primary bladder has a W-shaped segment above and a V-shaped segment below when uninflated. The inflation assembly also includes a primary tube 46. The primary tube has an intermediate extent extending through the primary aperture. The primary tube also has a lower end coupled to the primary bladder. The primary tube also has an upper end positionable in the mouth of the wearer for inflation. The majority of the intermediate extent is positionable in the small tunnel while not inflating. The majority of the intermediate extent is positionable outside of the small tunnel with the upper end in the mouth of the wearer while inflating.

Next provided is a wearer controlled primary clamp 50. The clamp is on the primary tube adjacent to the upper end. The clamp is adapted to be opened for inflation and deflation purposes. The clamp is adapted to be closed for precluding inflation and deflation.

Next provided is a swimming bra 54 fabricated of any appropriate fabric with a bladder fabricated of a water repellant polymer. The bra has two laterally spaced strap portions 56 above positioned over shoulders of the wearer. The bra also has a breast portion 58 below. The bra also has a front 60 and a back 62.

Each strap portion is formed with a large tunnel 66, 68 at the front of the bra. A top aperture 70 is formed in an upper extent of the one of the strap portions.

Next provided is a secondary inflation assembly 72. The secondary inflation assembly includes a first strap bladder 74 and a second strap bladder 76 in the large tunnels of the strap portions. Each strap bladder has an oval cross sectional configuration when inflated. The secondary inflation assembly also includes a secondary tube 78. The secondary tube has an intermediate extent passing through the top aperture. The secondary tube has a lower end coupled to the one of the strap bladders and an upper end positionable in the mouth of the wearer for inflation. The majority of the intermediate extent is positionable in the one of the strap portions while not inflating. The majority of the intermediate extent is positionable outside of the tunnel with the upper end in the mouth of the wearer while inflating. The primary tube is several times longer than the secondary tube.

Lastly, a wearer controlled primary clamp 82 is provided. The clamp is on the secondary tube adjacent to its upper end. The primary clamp is adapted to be opened for inflation and deflation purposes. The clamp is adapted to be closed for precluding inflation and deflation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An inflatable bathing suit system comprising:

swimming pants fabricated of an appropriate fabric, the pants having a top portion above positioned around the waist of the wearer and a bottom portion below positioned around the legs of the wearer and an intermediate portion between the top and bottom portions positioned around the thighs of the wearer, the pants also having a front and a back;

the top portion formed with a laterally extending small tunnel at the front of the pants, the intermediate portion being formed with a laterally extending large tunnel at the front of the pants, the intermediate portion having a volume between 40 percent and 60 percent greater than the volume of the small tunnel, the small tunnel having a side with an upper aperture, the large tunnel having a side beneath the side of the small tunnel;

an inflation assembly including an inflatable bladder within the large tunnel, the inflation assembly also including a tube having an intermediate extent extending through the upper aperture and having a lower end coupled to the bladder and having an upper end positionable in the mouth of a wearer for inflation, the majority of the intermediate extent slidably extending through the upper aperture and being positionable in the small tunnel while not inflating, the majority of the intermediate extent being positionable outside of the small tunnel with the upper end in the mouth of the wearer while inflating; and a wearer controlled clamp on the tube adjacent to the upper end, the clamp adapted to be opened for inflation and deflation purposes, the clamp adapted to be closed for precluding inflation and deflation.

2. An inflatable bathing suit system for selectively providing buoyancy to a bathing suit and its wearer at the discretion of the wearer, the system comprising, in combination:

swimming pants fabricated of any appropriate fabric with a bladder fabricated of a water repellant polymer, the pants having a top portion above positioned around the waist of the wearer and a bottom portion below positioned around the legs of the wearer and an intermediate portion between the top and bottom portions positioned around the thighs of the wearer, the pants also having a front and a back;

the top portion formed with a laterally extending small tunnel at the front of the pants, the intermediate portion being formed with a laterally extending large tunnel at the front of the pants, the intermediate portion having a volume between 40 percent and 60 percent greater than the volume of the small tunnel, the small tunnel having a side with an upper aperture, the large tunnel having a side beneath the side of the small tunnel, the pants having a lower aperture between the small and large tunnels;

a primary inflation assembly including a primary bladder in the large tunnel, the primary bladder having an oval cross sectional configuration when inflated and having a W-shaped segment above when uninflated and a V-shaped segment below when uninflated, the inflation assembly also including a primary tube having an intermediate extent extending through the upper aperture and having a lower end coupled to the primary bladder and having an upper end positionable in the mouth of the wearer for inflation, the majority of the intermediate extent slidably extending through the upper aperture and being positionable in the small tunnel while not inflating, the majority of the intermediate extent being positionable outside of the small tunnel with the upper end in the mouth of the wearer while inflating;

a wearer controlled primary clamp on the primary tube adjacent to the upper end, the clamp adapted to be opened for inflation and deflation purposes, the clamp adapted to be closed for precluding inflation and deflation;

a swimming bra fabricated of any appropriate fabric with a bladder fabricated of a water repellant polymer, the bra having two laterally spaced strap portions above positioned over shoulders of the wearer and a breast portion below, the bra also having a front and a back;

each strap portion formed with a large tunnel at the front of the bra, a top aperture formed in an upper extent of the one of the strap portions;

a secondary inflation assembly including a first and a second strap bladder in the large tunnels of the strap portions, each strap bladder having an oval cross sectional configuration when inflated, the secondary inflation assembly also including a secondary tube having an intermediate extent passing through the top aperture, the secondary tube having a lower end coupled to the one of the strap bladders and an upper end positionable in the mouth of the wearer for inflation, the majority of the intermediate extent being positionable in the one of the strap portions while not inflating, the majority of the intermediate extent being positionable outside of the tunnel with the upper end in the mouth of the wearer while inflating, the primary tube being several times longer than the secondary tube; and a wearer controlled primary clamp on the secondary tube adjacent to its upper end, the primary clamp adapted to be opened for inflation and deflation purposes, the clamp adapted to be closed for precluding inflation and deflation.

* * * * *